US008485571B2

(12) United States Patent
Shinoda et al.

(10) Patent No.: US 8,485,571 B2
(45) Date of Patent: Jul. 16, 2013

(54) DOOR LOCK APPARATUS FOR VEHICLE

(75) Inventors: Yasutaka Shinoda, Anjo (JP); Akira Tani, Anjo (JP); Toshio Machida, Toyota (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 772 days.

(21) Appl. No.: 12/260,425

(22) Filed: Oct. 29, 2008

(65) Prior Publication Data

US 2009/0108594 A1 Apr. 30, 2009

(30) Foreign Application Priority Data

Oct. 30, 2007 (JP) ..... 2007-282213

(51) Int. Cl.
*E05C 3/06* (2006.01)

(52) U.S. Cl.
USPC ..... 292/201; 292/216

(58) Field of Classification Search
USPC ..... 292/201, 216, 341.16; 70/262, 263, 70/150, 283
See application file for complete search history.

(56) References Cited

U.S. PATENT DOCUMENTS

| | | | | |
|---|---|---|---|---|
| 4,762,348 | A | 8/1988 | Matsumoto | |
| 4,875,723 | A * | 10/1989 | Compeau et al. | 292/201 |
| 6,053,543 | A * | 4/2000 | Arabia et al. | 292/201 |
| 6,279,361 | B1 * | 8/2001 | Baukholt et al. | 70/279.1 |
| 6,733,052 | B2 * | 5/2004 | Perkins et al. | 292/201 |
| 7,140,651 | B2 | 11/2006 | Brose | |
| 7,543,861 | B2 * | 6/2009 | Dupont et al. | 292/216 |
| 2002/0167179 | A1 | 11/2002 | Takamura | |
| 2005/0184534 | A1 | 8/2005 | Oberheide et al. | |
| 2007/0007774 | A1 | 1/2007 | Stefanic | |
| 2009/0108594 | A1 * | 4/2009 | Shinoda et al. | 292/200 |

FOREIGN PATENT DOCUMENTS

| | | | |
|---|---|---|---|
| JP | 62-101782 | A | 5/1987 |
| JP | 08-218710 | A | 8/1996 |
| JP | 2002-250163 | * | 6/2002 |

OTHER PUBLICATIONS

European Office Action dated May 7, 2013 issued in the corresponding European Patent Application No. 08253508.9-1603/2060711.

* cited by examiner

*Primary Examiner* — Carlos Lugo
*Assistant Examiner* — Mark Williams
(74) *Attorney, Agent, or Firm* — Buchanan Ingersoll & Rooney PC

(57) ABSTRACT

A door lock apparatus for a vehicle includes a latch mechanism engaged with and released from a striker, a first lever rotatably driven by a driving unit from a predetermined first initial position, a second lever operatively connected to the first lever and rotated from a predetermined second initial position and switching a state of the latch mechanism relative to the striker, a biasing member biasing the second lever to be returned to the second initial position, and an engagement portion provided at the first lever and releasing the second lever by thrusting the second lever in accordance with the rotational movement of the first lever returning to the first initial position from a constrained state where the second lever is constrained not to be returned to the second initial position after the second lever has changed the states of the latch mechanism.

7 Claims, 6 Drawing Sheets

DOOR LOCK APPARATUS FOR VEHICLE

CROSS REFERENCE TO RELATED APPLICATIONS

This application is based on and claims priority under 35 U.S.C. §119 to Japanese Patent Application 2007-282213, filed on Oct. 30, 2007, the entire contents of which is incorporated herein by reference.

FIELD OF THE INVENTION

The present invention relates to a door lock apparatus for a vehicle.

BACKGROUND

A known door lock apparatus for a vehicle is disclosed in JP62101782 (which will be hereinbelow referred to as reference 1). According to the door lock apparatus, an electric motor serving as an actuator is rotated selectively in clockwise and counter-clockwise directions. Accordingly, a latch mechanism is switched from an engaged state to a released state relative to the striker or from the released state to the engaged state relative to the striker.

According to the door lock apparatus in reference 1, a lever, which transmits a force of the actuator to the latch mechanism, may be tightly engaged with a member and constrained in a position obtained when the lever switches the state of the latch mechanism. In such a case, the lever may not return to a previous state where the state of the latch mechanism has not yet switched. Therefore, the latch mechanism may malfunction.

A need thus exists for a door lock apparatus for a vehicle which is not susceptible to the drawback mentioned above.

SUMMARY OF THE INVENTION

According to an aspect of the present invention, a door lock apparatus for a vehicle includes a latch mechanism provided at one of a body of the vehicle and a door of the vehicle, and engaged with and released from a striker provided at the other one of the body of the vehicle and the door of the vehicle, a first lever rotatably driven by a driving unit from a predetermined first initial position, a second lever operatively connected to the first lever and rotated from a predetermined second initial position in accordance with a rotational movement of the first lever from the first initial position, the second lever switching the latch mechanism between engaged and released states relative to the striker, a biasing member biasing the second lever to be returned to the second initial position in accordance with the rotational movement of the first lever returning to the first initial position, and an engagement portion provided at the first lever and releasing the second lever by thrusting the second lever in accordance with the rotational movement of the first lever returning to the first initial position, from a constrained state where the second lever is constrained not to be returned to the second initial position after the second lever has changed the states of the latch mechanism.

According to another aspect of the present invention, a door lock apparatus for a vehicle includes a latch mechanism provided at one of a body of the vehicle and a door of the vehicle, and engaged with and released from a striker provided at the other one of the body of the vehicle and the door of the vehicle, a driving lever rotatably driven by a driving unit from a predetermined initial position in first and second directions, a closing lever operatively connected to the driving lever and rotated from a predetermined closing operation initial position in accordance with a rotational movement of the driving lever from the initial position in the first direction to switch a state of the latch mechanism from the engaged state to the released state relative to the striker, a closing lever biasing member biasing the closing lever to be returned to the closing operation initial position in accordance with the rotational movement of the driving lever returning to the initial position, a releasing lever operatively connected to the driving lever and rotated from a predetermined releasing operation initial position in accordance with the rotational movement of the driving lever from the initial position in the second direction to switch the state of the latch mechanism from the engaged state to the released state relative to the striker, a releasing lever biasing member biasing the releasing lever to be returned to the releasing operation initial position in accordance with the rotational movement of the driving lever returning to the initial position, and an engagement portion provided at the driving lever and releasing at least one of the closing lever and the releasing lever by thrusting at least one of the closing lever and the releasing lever in accordance with the rotational movement of the driving lever returning to the initial position, from a constrained state where at least one of the closing lever and the releasing lever is constrained not to be returned to the corresponding initial position after at least one of the closing lever and the releasing lever has changed the states of the latch mechanism.

BRIEF DESCRIPTION OF THE DRAWINGS

The foregoing and additional features and characteristics of the present invention will become more apparent from the following detailed description considered with the reference to the accompanying drawings, wherein.

DETAILED DESCRIPTION

Figure 1:
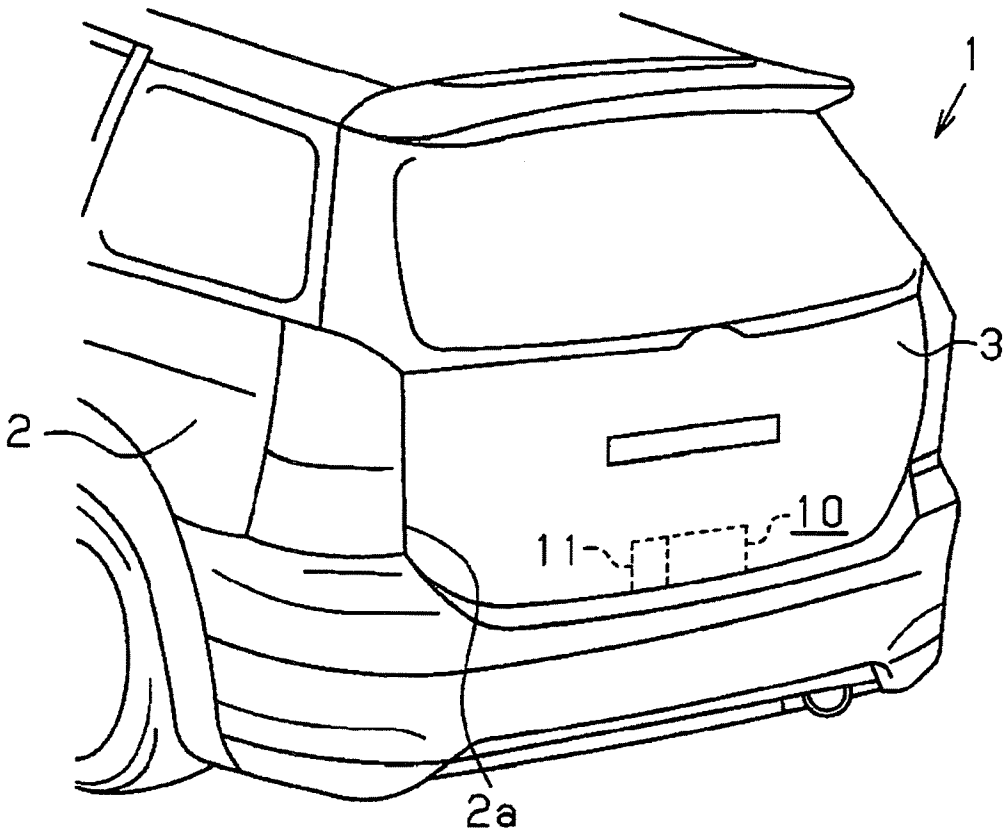
FIG. 1 is a perspective view illustrating a back portion of a vehicle according to an embodiment.

An embodiment of a door lock apparatus 10 will be described hereinbelow with reference to the attached drawings. FIG. 1 is a perspective view illustrating a back portion of a vehicle 1. As illustrated in FIG. 1, an opening portion 2*a* is formed at a back portion of a body 2 of the vehicle 1. A door hinge is provided at an upper portion of the opening portion 2*a*. A back door 3 (which serves as a door of a vehicle) is attached at the back portion of the body 2 of the vehicle 1 via the door hinge so as to be opened and closed. A U-shaped striker 4 (see FIG. 2A) is fixed at a bottom portion of the opening portion 2*a*. The door lock apparatus 10 is provided at an end portion of the back door 3 facing an inside of the vehicle 1. The door lock apparatus 10 is provided so as to face the striker 4 and to be engaged therewith. Further, the door lock apparatus 10 includes an electric motor 11 (which serves as a driving unit).

Figure 2B:
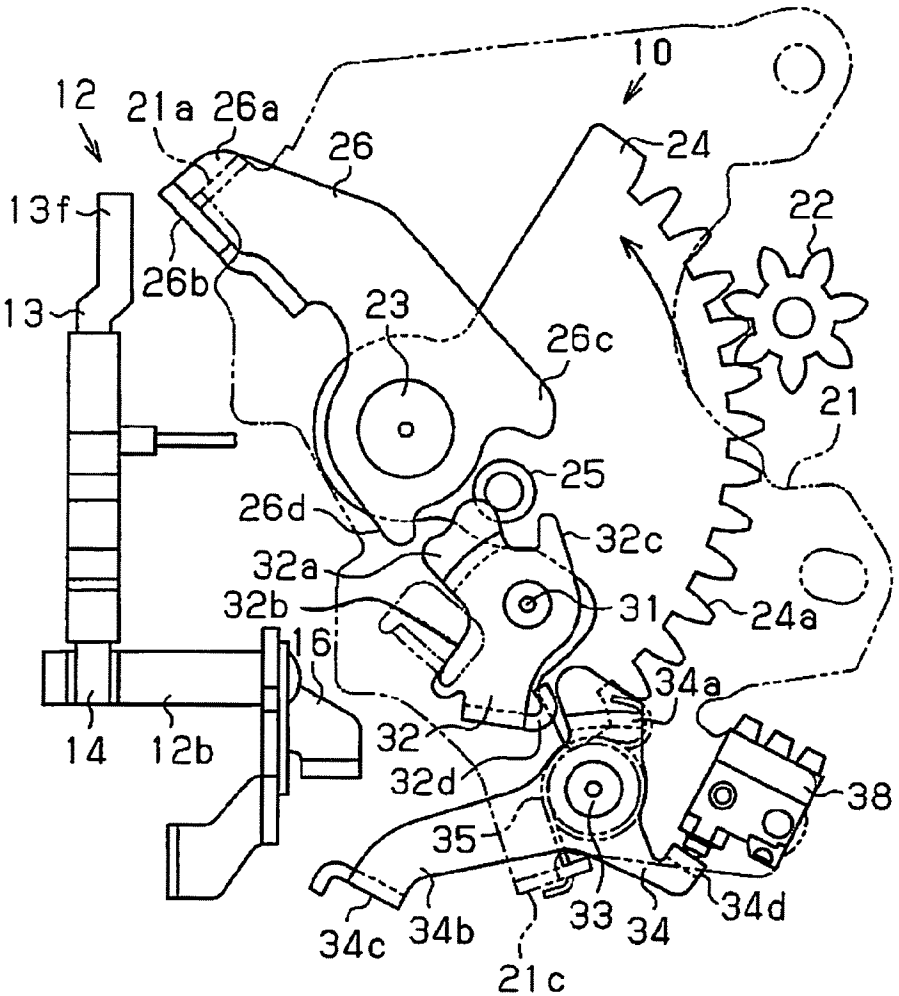
FIG. 2B is a front view illustrating the door lock apparatus according to the embodiment.
Figure 2A:
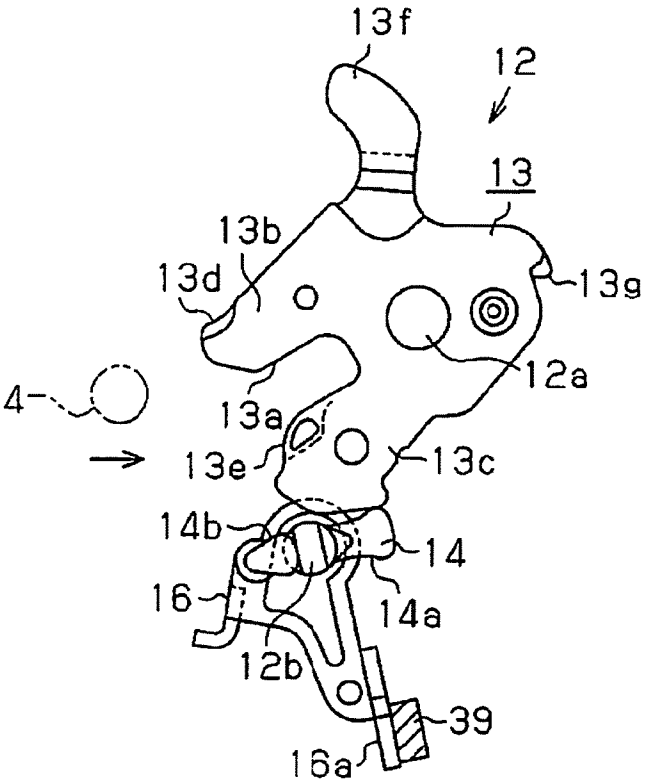
FIG. 2A is a side view illustrating a door lock apparatus according to the embodiment.

As illustrated in FIGS. 2A and 2B, the door lock apparatus 10 includes a latch mechanism 12. The latch mechanism 12 is supported by the back door 3 via a base plate, which is fixed at the back door 3. The latch mechanism 12 includes a latch 13 and a pawl 14. First and second pivotal shafts 12*a* and 12*b* are provided at the base plate so as to be parallel with each other. The latch 13 and the pawl 14 are pivoted around the first and second pivotal shafts 12*a* and 12*b*, respectively. Further, the latch mechanism 12 is engaged with and released from the striker 4.

More specifically, the latch 13 is formed in a U-shape and includes an engagement recessed portion 13*a*. First and second nail portions 13*b* and 13*c* are formed at both sides of the engagement recessed portion 13*a* (i.e. the first nail portion 13*b* is formed in an upper left direction of the engagement recessed portion 13*a* in FIG. 2A and the second nail portion 13*c* is formed in a lower right direction of the engagement recessed portion 13*a* in FIG. 2A.) A first engagement portion 13*d* is formed at an end portion of the first nail portion 13*b* at an opposite side from the engagement recessed portion 13*a*. A second engagement portion 13*e* is formed at an end portion of the second nail portion 13*c* at a side of the engagement recessed portion 13*a*. A driven protruding portion 13*f* is formed at the latch 13 so as to protrude in an opposite direction of the engagement recessed portion 13*a* across the first pivotal shaft 12*a*. One end of a latch biasing spring is held at the base plate and the other end thereof is engaged with the latch 13. The latch 13 is biased by the latch biasing spring so as to be pivoted in a clockwise direction in FIG. 2A. Further, when an opposing surface 13*g* of the first nail portion 13*b* contacts a latch stopper provided at the base plate, a pivotal movement of the latch 13 in the clockwise direction is restricted and the latch 13 is held at a first predetermined pivotal position illustrated in FIG. 2A.

The pawl 14 is connected to a lift lever 16 (see FIG. 2B) via the second pivotal shaft 12*b*. The pawl 14 is pivoted integrally with the lift lever 16 about the second pivotal shaft 12*b*. The pawl 14 includes an engagement end portion 14*a* and an extending end portion 14*b*. The engagement end portion 14*a* extends from the second pivotal shaft 12*b* in one direction (i.e. in a rightward direction in FIG. 2A). The extending end portion 14*b* extends from the second pivotal shaft 12*b* in an opposite direction (i.e. in a leftward direction in FIG. 2A). One end of a pawl biasing spring is held at the base plate and the other end thereof is engaged with the pawl 14. The pawl 14 is biased by the pawl biasing spring so as to be pivoted in a counter-clockwise direction in FIG. 2A (i.e. in a direction where the engagement end portion 14*a* is raised upward). Further, when a stopper contacting portion 16*a* of the lift lever 16 contacts a stopper 39 provided at the base plate, a pivotal movement of the pawl 14 in the counter-clockwise direction is restricted and the pawl 14 is held at a second predetermined pivotal position illustrated in FIG. 2A.

A basic operation of the latch mechanism 12 will be described hereinbelow. When the back door 3 is in an opened state, as illustrated in FIG. 2A, the latch 13 is held at the first predetermined pivotal position because the opposing surface 13*g* of the first nail portion 13*b* contacts the latch stopper. Therefore, when the back door 3 is being closed, the striker 4 approaches the engagement recessed portion 13*a*. Further, the pawl 14 is held at the second predetermined pivotal position because the lift lever 16 contacts the stopper 39. The engagement end portion 14*a* is positioned below the second nail portion 13*c*. The above-described state of the latch mechanism 12 is an unlatched state (a released state).

When the back door 3 is operated to close, the striker 4 approaches the engagement recessed portion 13*a*. Accordingly, an inner wall surface of the engagement recessed portion 13*a* is thrust by the striker 4. Therefore, the latch 13 is pivoted in the counter-clockwise direction in FIG. 2A against the latch biasing spring until the engagement end portion 14*a* is engaged with the second engagement portion 13*e*. In the above-described state, the back door 3 is in a half-closed state where the engagement recessed portion 13*a* is engaged with the striker 4 that is prevented from being released therefrom. In such a state, the latch mechanism 12 is in a half-latched state.

When the back door 3 is further operated to close, the striker 4 further approaches the engagement recessed portion 13*a*. Accordingly, the inner wall surface of the engagement recessed portion 13*a* is further thrust by the striker 4. Therefore, the latch 13 is pivoted in a counter-clockwise direction in FIG. 3A against the latch biasing spring until the engagement end portion 14*a* is engaged with the first engagement portion 13*d* (see FIG. 3A). In the above-described state, the back door 3 is in a closed state where the engagement recessed portion 13*a* is engaged with the striker 4 that is prevented from being further pivoted. In such a state, the latch mechanism 12 is in a fully latched state (an engaged state).

Figure 3B:
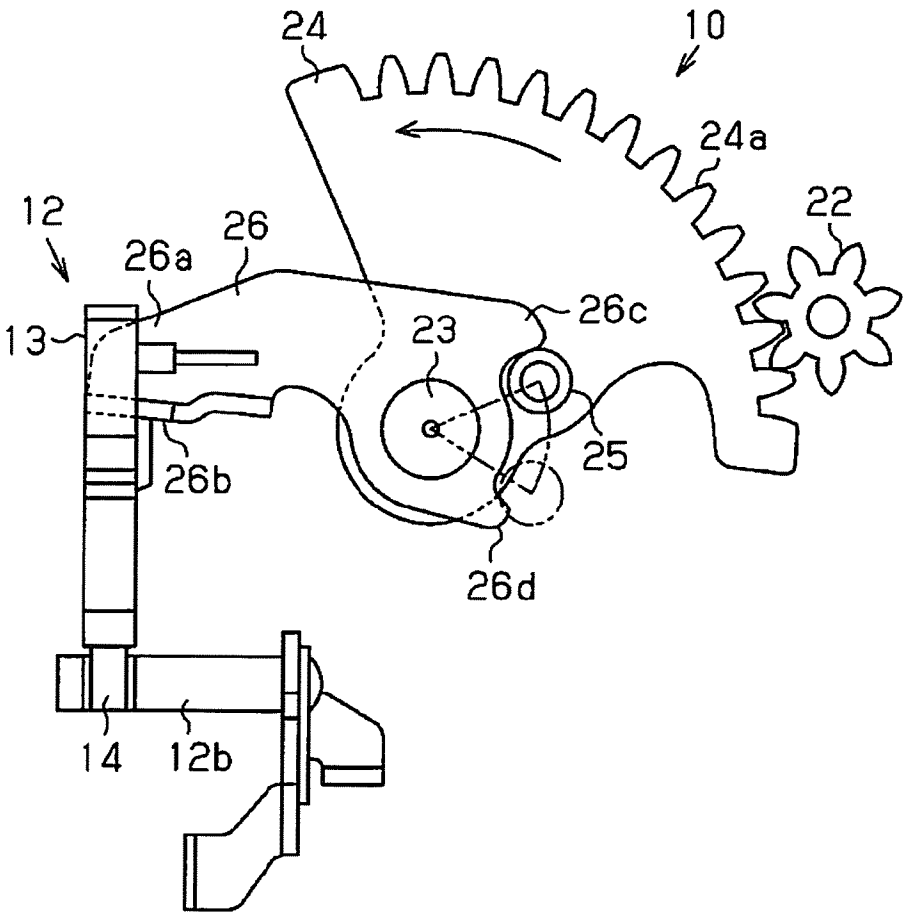
FIG. 3B is a front view illustrating the operation of the door lock apparatus according to the embodiment.
Figure 3A:
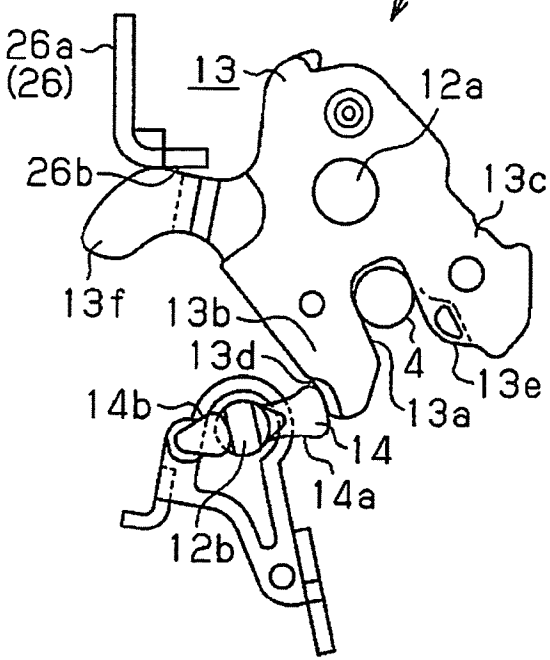
FIG. 3A is a side view illustrating an operation of the door lock apparatus according to the embodiment.

In the above-described half-latched or fully latched state, when the pawl 14 is pivoted in a clockwise direction in FIG. 3A against the pawl biasing spring, an engagement between the engagement end portion 14*a* and the first engagement portion 13*d* or between the engagement end portion 14*a* and the second engagement portion 13*e* is released. Accordingly, the latch 13 is biased by the latch biasing spring so as to be pivoted in the clockwise direction in FIG. 3A. Therefore, the striker 4 is thrust by the inner wall surface of the engagement recessed portion 13*a*. As a result, the engagement between the engagement portion 13*a* and the striker 4 is released, which causes the back door 3 to be opened.

As illustrated in FIG. 2B, the door lock apparatus 10 includes a bracket 21. The bracket 21 is fixed at the back door 3 and is made of a metal plate. A pinion 22 is arranged at the bracket 21. The pinion 22 is connected to an output shaft of the electric motor 11 so as to be integrally rotatable. A sectoral-shaped active lever 24 (which serves as a first lever or a driving lever) is made of a metal plate and is connected at the bracket 21 so as to be pivotable around a third pivotal shaft 23. The third pivotal shaft 23 extends in a different direction from axes of the first and second pivotal shafts 12*a* and 12*b* of the latch 13 and the pawl 14. More specifically, the third pivotal shaft 23 extends in a direction parallel with a rational axis of the pinion 22. The active lever 24 includes an arc-shaped gear portion 24*a*, which is engaged with the pinion 22. Therefore, a pivotal position of the active lever 24 is held by means of an engagement between the active lever 24 and the pinion 22. Normally, as illustrated in FIG. 2B, the active lever 24 is held at a predetermined pivotal position (which will be hereinbelow referred to as an initial position and which serves as a first initial position), where the gear portion 24*a* is engaged with the pinion 22 at a substantially intermediate position in a circumferential direction of the gear portion 24*a*. Further, an active lever pin 25 (which serves as an engagement portion or as an engagement pin) is provided at the active lever 24 in the vicinity of the third pivotal shaft 23 so as to protrude parallel with the third pivotal shaft 23 in a thickness direction of the active lever 24 (i.e. in a direction vertical to the paper surface of FIG. 2B)

A passive lever 26 (which serves as a second lever or as a closing lever), which is made of a metal plate, is connected to the bracket 21 so as to be pivotable around the third pivotal shaft 23. The passive lever 26 includes a first lever portion 26*a* and a first thrusting strip 26*b*. The first lever portion 26*a* extends from the third pivotal shaft 23 in a radial direction of the pivotal shaft 23. The first thrusting strip 26*b* is formed by bending an end portion of the first lever portion 26*a*. The driven protruding portion 13*f* of the latch 13 is provided at a position on a pivotal locus along which the first thrusting strip 26*b* pivots around the third pivotal shaft 23 in a counter-clockwise direction in FIG. 2B. Therefore, when the passive lever 26 is pivoted in the counter-clockwise direction in FIG. 2B, the driven protruding portion 13*f* is thrust by the first thrusting strip 26*b*. Accordingly, the latch 13 is pivoted in the counter-clockwise direction in FIG. 2A until the latch 13 is engaged with the pawl 14 (see FIG. 3A) in a manner described above. Thus, the latch mechanism 12 is switched to the fully latched state.

A first engagement strip 26*c* is provided at a base end portion of the passive lever 26. More specifically, the first engagement strip 26*c* is provided at a position on a pivotal locus along which the active lever pin 25 is pivoted about the third pivotal shaft 23 in the counter-clockwise direction in FIG. 2B. Likewise, a second engagement strip 26*d* (which serves as an engagement strip) is provided at the base end portion of the passive lever 26. More specifically, the second engagement strip 26*d* is provided at a position on a pivotal locus along which the active lever pin 25 is pivoted about the third pivotal shaft 23 in a clockwise direction in FIG. 2B. One end of a first returning spring (which serves as a biasing member or as a closing lever biasing member) is engaged with the bracket 21. The other end of the first returning spring is engaged with the passive lever 26. Therefore, the passive lever 26 is biased by the first returning spring so as to be pivoted in the clockwise direction in FIG. 2B. A pivotal movement of the passive lever 26 in such direction is restricted when an opposing surface of the first thrusting strip 26*b* contacts a passive lever stopper 21*a*, which is provided at the bracket 21. Thus, the passive lever 26 is held at a predetermined pivotal position (which will be hereinbelow referred to as a closing operation initial position and which serves as a second initial position), illustrated in FIG. 2B. When the passive lever 26 is in the closing operation initial position, the active lever pin 25 is arranged between the first and second engagement strips 26*c* and 26*d* in a circumferential direction defined by a rotational locus of the passive lever 26 centering the third pivotal shaft 23. Therefore, when the active lever 24 is pivoted in the counter-clockwise direction in FIG. 2B, the first engagement strip 26*c* of the passive lever 26 is thrust by the active lever pin 25. Accordingly, the passive lever 26 is pivoted in the counter-clockwise direction in FIG. 2B. As a result, in the above-described manner, the latch mechanism 12 is switched to the fully latched state (see FIG. 3A).

Figure 4B:
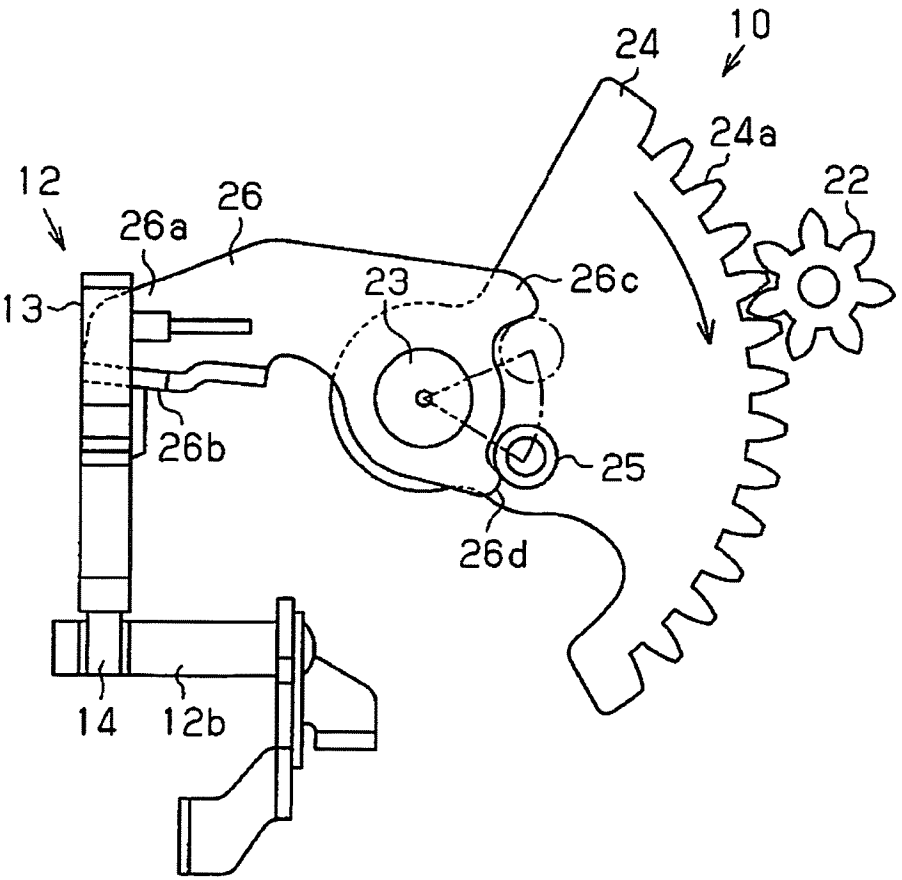
FIG. 4B is a front view illustrating the operation of the door lock apparatus according to the embodiment.

After the passive lever 26 is located at a pivotal position where the latch mechanism 12 is switched into the fully latched state, the active lever pin 25 thrusts the second engagement strip 26*d* when the active lever 24 is pivoted back to the initial position (see FIG. 4B). Therefore, even when the passive lever 26 is tightly engaged with the latch 13 and constrained so as not to be capable of returning back to the closing operation initial position, in accordance with a pivotal movement of the active lever 24 back to the initial position, the second engagement strip 26*d* is thrust by the active lever pin 25 (see FIG. 4B), and thereby a constraint state of the passive lever 26 is released. Accordingly, the passive lever 26 is smoothly pivoted back to the closing operation initial position, biased by the first returning spring.

A bell crank 32 (which serves as a second lever or as a releasing lever), which is made of a metal-plate, is connected to the bracket 21 so as to be pivotable around a fourth pivotal shaft 31. The fourth pivotal shaft 31 is provided to be parallel with the third pivotal shaft 23. The bell crank 32 includes a second lever portion 32*a* and a third lever portion 32*b*. The second lever portion 32*a* extends from the fourth pivotal shaft 31 in a radial direction of the fourth pivotal shaft 31 (i.e. in an upper left direction relative to the fourth pivotal shaft 31 in FIG. 2B). The third lever portion 32*b* extends from the fourth pivotal shaft 31 in another radial direction of the fourth pivotal shaft 31 (i.e. in a lower direction relative to the fourth pivotal shaft 31 in FIG. 2B). The second lever portion 32*a* is provided at a position on a pivotal locus along which the active lever pin 25 is pivoted around the third pivotal shaft 23 in the clockwise direction in FIG. 2B. When the active lever 24 and the active lever pin 25 are pivoted in the clockwise direction in FIG. 2B, the active lever pin 25 thrusts the second lever portion 32*a*. Therefore, the bell crank 32 is pivoted in the counter-clockwise direction in FIG. 2B. In other words, pivotal directions of the active lever 24 and the bell crank 32 are opposite from each other.

When the bell crank 32 is thrust by the active lever pin 25, the bell crank 32 is pivoted in the counter-clockwise direction from a position of the bell crank 32 in FIG. 2B. Then, the bell crank 32 is positioned to space away from a portion of the bracket 21, which is formed by bending the bracket 21 in a thickness direction thereof. Thus, the bell crank 32 is positioned at a releasing operation initial position (which serves as a second initial position). More specifically, the releasing operation initial position is where the active lever pin 25 thrusts the bell crank 32 in the counter-clockwise direction in FIG. 2B, accordingly the bell crank 32 thrusts an opening lever 34 (which serves as a third lever), and therefore a switch thrusting portion 34*d* is positioned to be spaced away from the switch 38. Further, the bell crank 32 includes a protruding portion 32*c* (which serves as an engagement strip) and a second thrusting strip 32*d*. The protruding portion 32*c* is protruding in a radial direction of the fourth pivotal shaft 31 and is provided so as to be adjacent to the second lever portion 32*a*. The second thrusting strip 32*d* is formed by bending an end portion of the third lever portion 32*b*.

The opening lever 34, which is made of a metal-plate, is connected to the bracket 21 so as to be pivotable around a fifth pivotal shaft 33. The fifth pivotal shaft 33 is provided so as to be parallel to the third and fourth pivotal shafts 23 and 31. The opening lever 34 includes fourth and fifth lever portions 34*a* and 34*b*. The fourth lever portion 34*a* extends in one direction from the fifth pivotal shaft 33 (i.e. in an upper direction relative to the fifth pivotal shaft 33 in FIG. 2B). The fifth lever portion 34*b* extends in another direction from the fifth pivotal shaft 33 (i.e. in a lower left direction relative to the fifth pivotal shaft 33 in FIG. 2B). The fourth lever portion 34*a* is provided at a position on a locus along which the second thrusting strip 32*d* is pivoted in the counter-clockwise direction in FIG. 2B. When the bell crank 32 is pivoted in the counter-clockwise direction in FIG. 2B, the second thrusting strip 32*d* thrusts the fourth lever portion 34*a*. Accordingly, the opening lever 34 is pivoted in the clockwise direction in FIG. 2B. In other words, pivotal directions of the bell crank 32 and the opening lever 34 are opposite from each other and pivotal directions of the active lever 24 and the opening lever 34 are the same.

The opening lever 34 includes a third thrusting strip 34*c*, which is formed by bending an end portion of the fifth lever portion 34*b*. The lift lever 16 is provided at a position on a pivotal locus along which the fifth lever portion 34*b* is pivoted around the fifth pivotal shaft 33 in the clockwise direction in FIG. 2B. Therefore, when the latch mechanism 12 is in the fully latched state (see FIGS. 5A and 5B), the opening lever 34 is pivoted in a clockwise direction in FIG. 5B. Then, the lift lever 16 is thrust by the third thrusting strip 34*c*. Accordingly, the lift lever 16 and the pawl 14 are pivoted in a clockwise direction in FIG. 5A. In the above-described manner, an engagement between the pawl 14 and the latch 13 is released. Thus, the latch mechanism 12 is switched to the unlatched state.

A third engagement strip 21*c* is formed at the bracket 21. One end of a second returning spring 35 (which serves as a biasing member or as a releasing lever biasing member) is engaged with the third engagement strip 21*c*. The other end of the second returning spring 35 is engaged with the fourth lever portion 34*a* of the opening lever 34. Therefore, the opening lever 34 is biased in the counter-clockwise direction in FIG. 2B. When the second thrusting strip 32*d* of the bell crank 32, whose pivotal movement is restricted at the releasing operation initial position, contacts an opposing surface of the fourth lever portion 34*a*, a pivotal movement of the opening lever 34 in the counter-clockwise direction in FIG. 2B is restricted. Thus, as illustrated in FIG. 2B, the opening lever 34 is held at a predetermined pivotal position (which serves as a third initial position or as an opening operation initial position). In other words, the bell crank 32 is held at the releasing operation initial position, biased by the second returning spring 35 via the opening lever 34. Further, when the bell crank 32 is at the releasing operation initial position, the active lever pin 25 is arranged between the second lever portion 32*a* and the protruding portion 32*c* in a circumferential direction defined by a rotational locus of the bell crank 32 centering the fourth pivotal shaft 31.

Therefore, when the active lever 24 is pivoted in the clockwise direction in FIG. 2B, the active lever pin 25 thrusts the second lever portion 32*a*. Then, the bell crank 32 is pivoted in the counter-clockwise direction in FIG. 2B. Accordingly, the second thrusting strip 32*d* thrusts the fourth lever portion 34*a*. Then, the opening lever 34 is pivoted in the clockwise direction in FIG. 2B (see FIG. 6). As a result, in the manner described above, the latch mechanism 12 is switched to the unlatched state.

Figure 7:
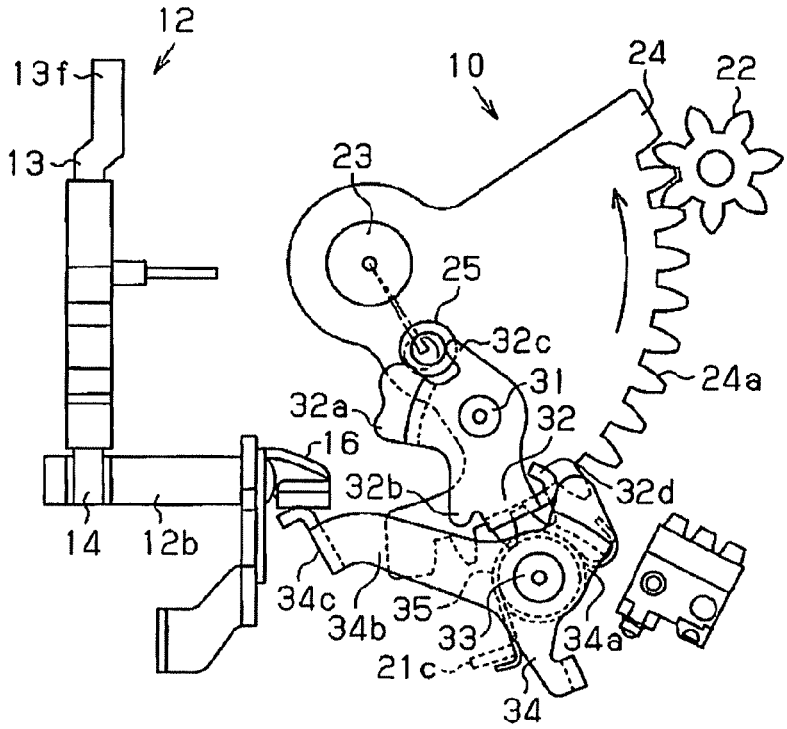
FIG. 7 is a front view illustrating the operation of the door lock apparatus according to the embodiment.

After the bell crank 32 is located at a pivotal position where the latch mechanism 12 is switched into the unlatched state via the opening lever 34, the active lever pin 25 thrusts the protruding portion 32*c* when the active lever 24 is pivoted back to the initial position (see FIG. 7). Therefore, even when the bell crank 32 is tightly engaged with the opening lever 34 and constrained so as not to be capable of returning back to the releasing operation initial position, in accordance with a pivotal movement of the active lever 24 back to the initial position, the protruding portion 32*c* is thrust by the active lever pin 25 (see FIG. 7), and thereby a constraint of the bell crank 32 is released. Accordingly, the bell crank 32 is smoothly pivoted back to the releasing operation initial position, biased by the second returning spring 35 via the opening lever 34.

An operation of the door lock apparatus 10 according to the embodiment will be described hereinbelow. While the latch mechanism 12 is in the unlatched state as illustrated in FIGS. 2A and 2B, the striker 4 approaches the engagement recessed portion 13*a* of the latch 13 in accordance with a closing operation of the back door 3. Then, the pinion 22 is rotated in the clockwise direction in FIG. 2B. The active lever 24 is pivoted from the initial position in the counter-clockwise direction in FIG. 2B. A pivotal movement of the active lever pin 25, which is integrally formed at the active lever 24, is transmitted to the latch 13 via the passive lever 26. The latch 13 is pivoted in the counter-clockwise direction in FIG. 2A, engaging the striker 4 which is located at the engagement recessed portion 13*a*. Then, in the above-described manner, the latch 13 is engaged with the pawl 14 and prevented from being further pivoted (see FIG. 3A). Thus, the latch mechanism 12 is switched to the fully latched state. The back door 3 is held in a fully closed state.

Subsequently, when the pinion 22 is rotated in a counter-clockwise direction in FIG. 3B, the active lever 24 is pivoted in a clockwise direction in FIG. 3B to return back to the initial position. The passive lever 26 is released from the active lever pin 25. Normally, the passive lever 26 is pivoted back to the closing operation initial position biased by the first returning spring. Thus, the latch 13 is released from the passive lever 26.

Figure 4A:
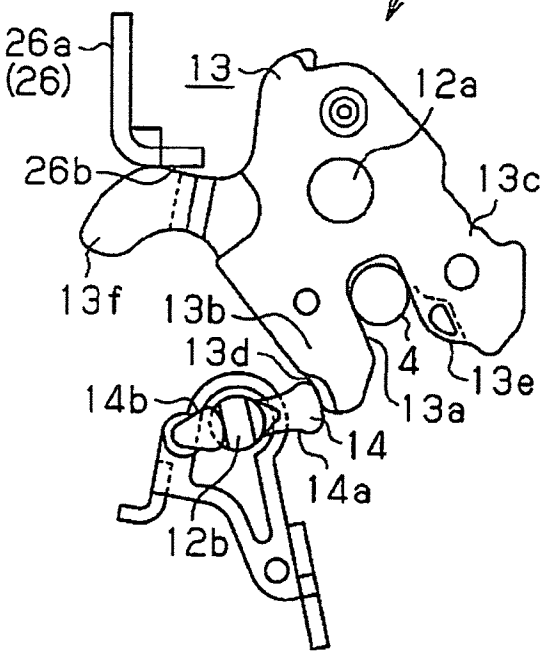
FIG. 4A is a side view illustrating the operation of the door lock apparatus according to the embodiment.

On the other hand, as illustrated in FIGS. 4A and 4B, the passive lever 26 is, for example, tightly engaged with the latch 13 and constrained so as not to be capable of returning back to the closing operation initial position. While the passive lever 26 is in such a state, the active lever 24 is pivoted back to the initial position. Then, the active lever pin 25 thrusts the second engagement strip 26*d* of the passive lever 26, and thereby the constraint of the passive lever 26 is released. Accordingly, the passive lever 26 is smoothly pivoted back to the closing operation initial position, biased by the first returning spring. Thus, the latch mechanism 12 is prevented from malfunctioning.

Figure 5B:
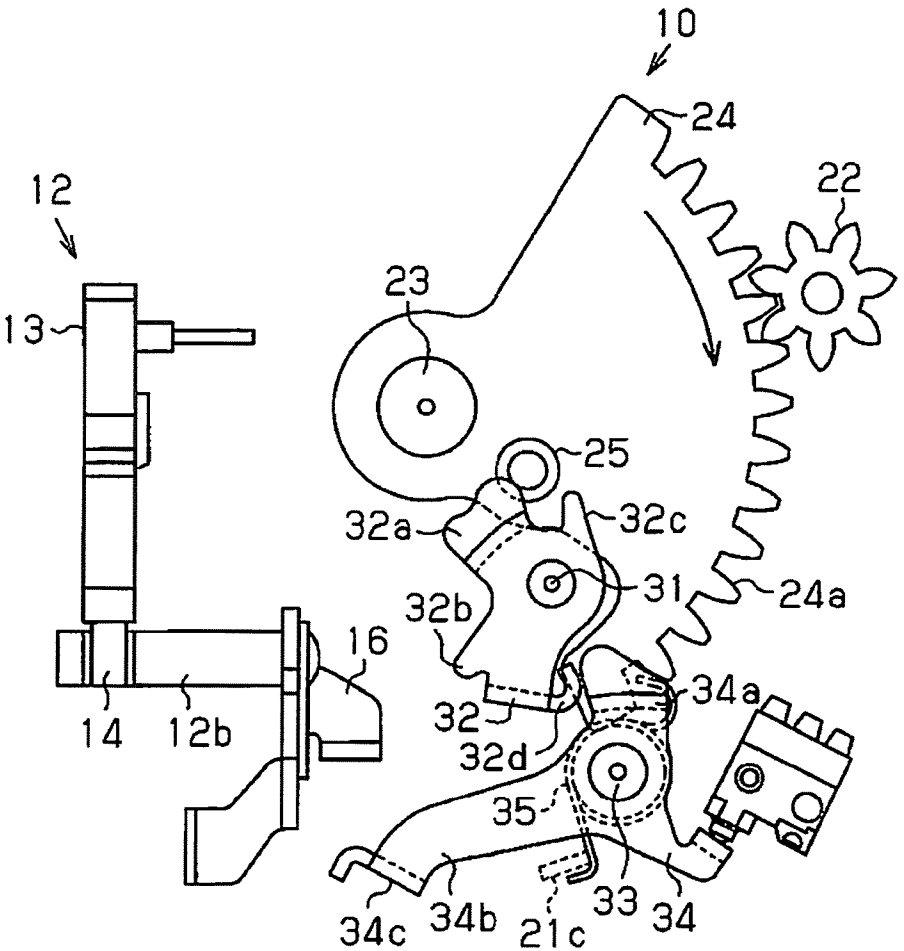
FIG. 5B is a front view illustrating the operation of the door lock apparatus according to the embodiment.
Figure 5A:
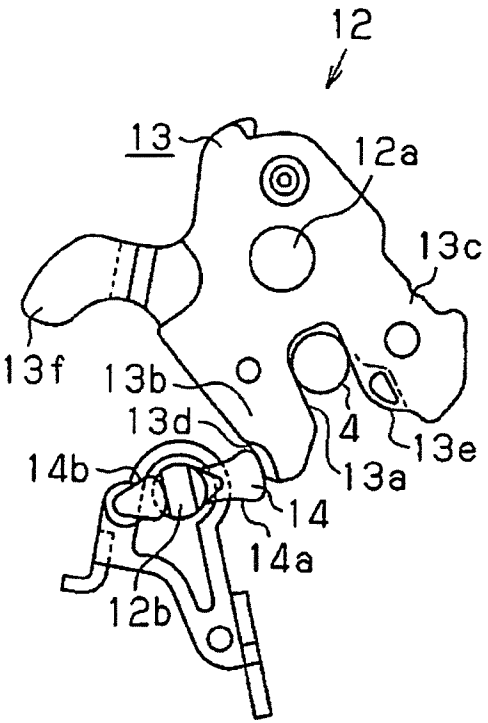
FIG. 5A is a side view illustrating the operation of the door lock apparatus according to the embodiment.

Further, while the latch mechanism 12 is in the fully latched state as illustrated in FIGS. 5A and 5B, the pinion 22 is rotated in the counter-clockwise direction in FIG. 5B. The active lever 24 is pivoted in the clockwise direction in FIG. 5B from the initial position. The pivotal movement of the active lever pin 25, which is integrally formed at the active lever 24, is transmitted to the lift lever 16 via the bell crank 32 and the opening lever 34. The lift lever 16 is pivoted in a clockwise direction in FIG. 5A together with the pawl 14. Then, in the above-described manner, the latch 13 is released from the pawl 14. The striker 4 is released from the latch 13. Thus, the latch mechanism 12 is switched to the unlatched state. Accordingly, the back door 3 can be opened.

Figure 6:
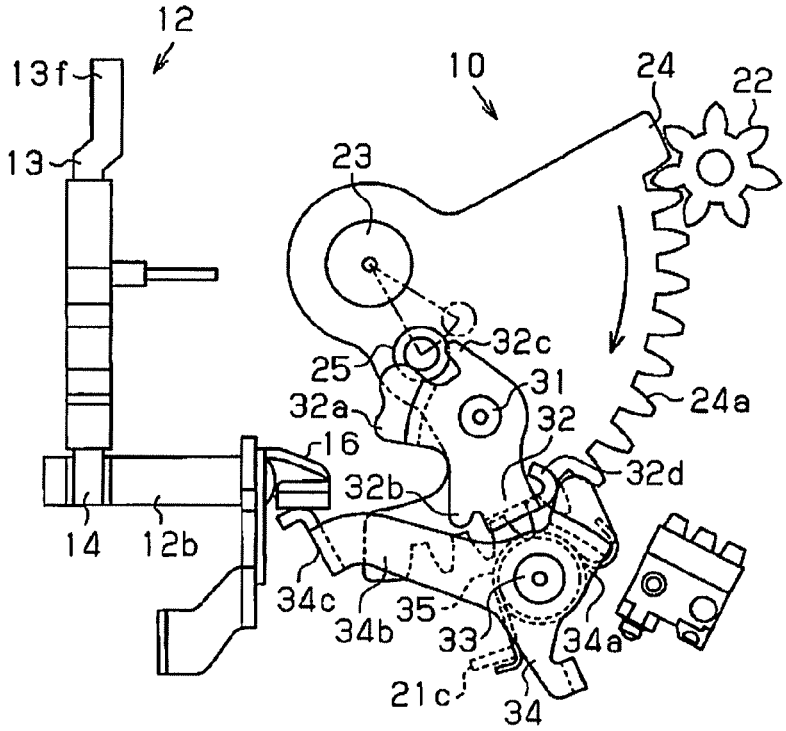
FIG. 6 is a front view illustrating the operation of the door lock apparatus according to the embodiment.

Subsequently, when the pinion 22 is rotated in a clockwise direction in FIG. 6, the active lever 24 is pivoted in a counter-clockwise direction in FIG. 6 to return back to the initial position. The bell crank 32 is released from the active lever pin 25. Normally, the bell crank 32 is pivoted back to the releasing operation initial position biased by the second returning spring 35 via the opening lever 34. Thus, the lift lever 16 is released from the opening lever 34.

On the other hand, as illustrated in FIGS. 7A and 7B, the bell crank 32 is, for example, tightly engaged with the opening lever 34 and constrained so as not to be capable of returning back to the releasing operation initial position. While the bell crank 32 is in such a state, the active lever 24 is pivoted back to the initial position. Then, the active lever pin 25 thrusts the protruding portion 32*c* of the bell crank 32, and thereby the constraint of the bell crank 32 is released. Accordingly, the bell crank 32 is smoothly pivoted back to the releasing operation initial position, biased by the second returning spring 35. Thus, the latch mechanism 12 is prevented from malfunctioning.

As described above, the following effects may be obtained according to the embodiment. The passive lever 26, which has switched the latch mechanism 12 from the unlatched state to the fully latched state, may be constrained so as not to return back to the closing operation initial position. Then, in accordance with the pivotal movement of the active lever 24 back to the initial position, the active lever pin 25 thrusts the second engagement strip 26*d* of the passive lever 26. Accordingly, the constraint of the passive lever 26 is released. Therefore, the passive lever 26 is pivoted back to the closing operation initial position, biased by the first returning spring. As a result, such malfunction that the latch mechanism 12 fails to be switched to a subsequent state, due to the constraint of the passive lever 26, is prevented.

According to the embodiment, the bell crank 32, which has switched the latch mechanism 12 from the fully latched state to the unlatched state, may be constrained so as not to return back to the releasing operation initial position. Then, in accordance with the pivotal movement of the active lever 24 back to the initial position, the active lever pin 25 thrusts the protruding portion 32*c* of the bell crank 32. Accordingly, the constraint of the bell crank 32 is released. Therefore, the bell crank 32 is pivoted back to the releasing operation initial position, biased by the second returning spring 35. As a result, such malfunction that the latch mechanism 12 fails to be switched to a subsequent state, due to the constraint of the bell crank 32, is prevented.

Thus, a reliability of the door lock apparatus 10 is improved. According to the embodiment, a pivotal direction of the active lever 24 is changed by means of the bell crank 32 before the pivotal movement of the active lever 24 is transmitted to the opening lever 34. Further, the state of the latch mechanism 12 is switched by the bell crank 32 via the opening lever 34. Therefore, sizes and structures of the bell crank 32, the opening lever 34, the lift lever 26, and the like related to the pivotal transmission, for example, are prevented from being enlarged and being complicated, respectively. Accordingly, components may be freely arranged and can be easily mounted.

According to the embodiment, the active lever pin 25 for establishing transmission and operative connection between the active lever 24 and the passive lever 26 (between the active lever 24 and the bell crank 32) also serves as an engagement portion for preventing the malfunction of the latch mechanism 12. Therefore, the number of components is decreased.

Further, the above-described embodiment may be changed as follows: A known separation means (see JP8218710A, for example) may be provided either between the electric motor 11 and the passive lever 26 or between the electric motor 11 and the opening lever 34. The separation means manually disconnects a mechanical connection therebetween. Therefore, even when the electric motor 11 malfunctions, the constraint of either passive lever 26 or the opening lever 34 due to the malfunction of the electric motor 11 may be manually released. Therefore, the latch mechanism 12 is prevented from malfunctioning. Then, the back door 3 can be opened and closed.

In a case where the bell crank 32 is operatively connectable with the left lever 16, the bell crank 32 may directly operate the lift lever 16, without arranging the opening lever 34 therebetween. In such a case, a returning spring returning the bell crank 32 to the releasing operation initial position may directly bias the bell crank 32.

The latch mechanism 12 (the door lock apparatus 10) may be provided at the body 2 of the vehicle 1. In such a case, the striker 4 may be provided at the back door 3 of the vehicle 1.

According to the present invention, it can prevent a latch mechanism of a door lock apparatus for a vehicle from malfunctioning.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the sprit of the present invention. Accordingly, it is expressly intended that all such variations, changes and equivalents which fall within the spirit and scope of the present invention as defined in the claims, be embraced thereby.

The invention claimed is:

1. A door lock apparatus for a vehicle comprising:

a latch mechanism provided at one of a body of the vehicle and a door of the vehicle, and engaged with and released from a striker provided at the other one of the body of the vehicle and the door of the vehicle;

a driving lever rotatably driven by a driving unit from a predetermined initial position in first and second directions;

a closing lever operatively connected to the driving lever and rotated from a predetermined closing operation initial position in accordance with a rotational movement of the driving lever from the initial position in the first direction to switch a state of the latch mechanism from the engaged state to the released state relative to the striker;

a closing lever biasing member biasing the closing lever to be returned to the closing operation initial position in accordance with the rotational movement of the driving lever returning to the initial position;

a releasing lever operatively connected to the driving lever and rotated from a predetermined releasing operation initial position in accordance with the rotational movement of the driving lever from the initial position in the second direction to switch the state of the latch mechanism from the engaged state to the released state relative to the striker;

a releasing lever biasing member biasing the releasing lever to be returned to the releasing operation initial position in accordance with the rotational movement of the driving lever returning to the initial position;

an engagement portion provided at the driving lever and releasing both of the closing lever and the releasing lever by thrusting directly both of the closing lever and the releasing lever to rotate in accordance with the rotational movement of the driving lever returning to the initial position, from a constrained state where the closing lever and the releasing lever are constrained not to be returned to the closing operation initial position and the releasing operation initial position, respectively, after both of the closing lever and the releasing lever have changed the states of the latch mechanism, the engagement portion being positioned between the closing lever and the releasing lever; and an engagement strip provided at at least one of the closing lever and the releasing lever and thrust by the engagement portion, provided at the driving lever, in accordance with the rotational movement of the driving lever returning to the initial position, wherein a first pivotal shaft serves as a common pivotal axis of the driving lever and the closing lever, and a second pivotal shaft serves as a pivotal axis of the releasing lever and is arranged parallel to the first pivotal shaft, and wherein the engagement strip includes: (1) a first engagement strip provided at a base end portion of the closing lever at a position on a pivotal locus along which the engagement portion moves pivoting about the first pivotal shaft, and (2) a second engagement strip provided at a base end portion of the closing lever at a position on the pivotal locus at an opposite direction from the position at which the first engagement strip is positioned, whereby when the closing lever is in the predetermined closing operation initial position, the engagement portion is positioned at a middle position between the first engagement strip and the second engagement strip in a circumferential direction.

2. The door lock apparatus according to claim 1, wherein the releasing lever is a bell crank.

3. The door lock apparatus according to claim 1, wherein the engagement portion of the driving lever is an engagement pin thrusting the engagement strip.

4. The door lock apparatus according to claim 1, further comprising:

an opening lever operatively connected to the releasing lever and rotated from an opening operation initial position in accordance with a rotational movement of the releasing lever from the releasing operation initial position, wherein the releasing lever transmits the rotational movement of the driving lever to the opening lever so as to change a rotational direction of the driving lever, and the releasing lever switches the state of the latch mechanism via the opening lever.

5. The door lock apparatus according to claim 1, wherein the second pivotal shaft is provided at a bracket which is fixed to the door.

6. The door lock apparatus according to claim 1, wherein when the closing lever is located at a pivotal position where the latch mechanism is switched into a fully latched state, the engagement portion thrusts the second engagement strip while the closing lever is returning back to the initial position.

7. The door lock apparatus according to claim 1, wherein the releasing lever includes a first lever portion and a second lever portion which extends from the second pivotal shaft in a first radial direction and a second radial direction, respectively; and the first lever portion is positioned on the pivotal locus along which the engagement portion moves pivoting about the first pivotal shaft.

* * * * *